US005246512A

United States Patent [19]

Seki et al.

[11] Patent Number: 5,246,512

[45] Date of Patent: Sep. 21, 1993

[54] CONTACT FOR A VACUUM INTERRUPTER

[75] Inventors: Tsuneyo Seki, Fuchu; Tsutomu Okutomi, Yokohama; Atsushi Yamamoto, Hino; Kiyofumi Otobe, Hachioji; Tadaaki Sekiguchi, Yokohama, all of Japan

[73] Assignee: Kabushiki Kaisha Toshiba, Kawasaki, Japan

[21] Appl. No.: 711,072

[22] Filed: Jun. 6, 1991

[30] Foreign Application Priority Data

Jun. 7, 1990 [JP] Japan ..... 2-147491
Oct. 22, 1990 [JP] Japan ..... 2-282032

[51] Int. Cl.[5] ..... H01H 1/00

[52] U.S. Cl. ..... 148/668; 200/265; 200/266; 420/495; 420/497

[58] Field of Search ..... 148/668; 420/495, 497; 200/265, 266

[56] References Cited

U.S. PATENT DOCUMENTS

| | | | |
|---|---|---|---|
| 3,359,623 | 12/1967 | Gwynn, Jr. | 29/420.5 |
| 4,048,117 | 9/1977 | Emmerich | 252/513 |
| 4,499,009 | 2/1985 | Yamanaka et al. | 200/266 |
| 4,686,338 | 8/1987 | Kashwagi et al. | 200/266 |
| 4,743,718 | 5/1988 | Santilli | 200/266 |
| 4,780,582 | 10/1988 | Haessler et al. | 200/266 |

FOREIGN PATENT DOCUMENTS

| | | |
|---|---|---|
| 0172411 | 2/1986 | European Pat. Off. . |
| 0178796 | 4/1986 | European Pat. Off. . |
| 41-12131 | 5/1966 | Japan . |
| 44-23751 | 8/1969 | Japan . |
| 61-41091 | 12/1986 | Japan . |

OTHER PUBLICATIONS

Japanese Patent Publ. No. 88728/1990 (Abstract only) Mar. 1990.

Japanese Patent Publ. No. 96621/1986 (including Abstract) May 1986.

*Primary Examiner*—Upendra Roy
*Attorney, Agent, or Firm*—Foley & Lardner

[57] ABSTRACT

The present invention relates to a contact for a vacuum interrupter obtained by processing a contact-forming material comprising from 20% to 60% by weight of Cr, Bi in an amount of from 0.05% to 1.0% by weight of the total amount of Cu and Bi, and the balance substantially Cu into the shape of a contact, and thereafter subjecting the processed material to vacuum heat treatment. The contact for the vacuum interrupter has both excellent anti-welding characteristics and excellent voltage withstanding characteristics.

20 Claims, No Drawings

CONTACT FOR A VACUUM INTERRUPTER

BACKGROUND OF THE INVENTION

This invention relates to a contact for a vacuum interrupter and, more particularly, to a contact for a vacuum interrupter having both improved anti-welding characteristic and improved voltage withstanding characteristic and a process for producing the same.

Contacts for a vacuum interrupter for carrying out large current interruption or rated current make and break in a high vacuum utilizing an arc diffusion property in a vacuum, are constituted of two opposing contacts, i.e., stationary and movable contacts. Principal characteristics required for such a contact for a vacuum interrupter are anti-welding property, voltage withstanding capability, and current interrupting property. Important requirements other than these fundamental requirements are low and stable temperature rise and low and stable contact resistance. However, these requirements contradict each other and therefore it is impossible to meet all of the requirements by a single metal. Accordingly, in many contacts which have been practically used, at least two elements which compensate mutually inadequate performance thereof have been used in combination to develop contact which are suitable for specific uses at a large current, at a high voltage or at other conditions. Contacts having excellent characteristics have been developed. However, demands for a contact for a vacuum interrupter which withstands higher voltage and larger current have increased, and a contact for the vacuum interrupter which entirely meets such requirements has not been obtained.

For example, Japanese Patent Publication No. 12131/1966 discloses a Cu-Bi alloy containing no more than 5% of an anti-welding component such as Bi. This reference describes that the Cu-Bi alloy can be used as a contact which is used at a large current. However, the solubility of Bi in the Cu matrix is extremely low, and therefore segregation occurs. Further, the surface roughening after current interruption is large and it is difficult to carry out processing or forming.

Japanese Patent Publication No. 23751/1969 discloses the use of a Cu-Te alloy as a contact which is used at a large current. While this alloy alleviates the problems associated with the Cu-Bi alloy, it is more sensitive to an atmosphere as compared with the Cu-Bi alloy. Accordingly, the Cu-Te alloy lacks the stability of contact resistance or the like.

Furthermore, although both the contacts formed from the Cu-Te alloy and those from the Cu-Bi alloy have excellent anti-welding properties in common and can be used sufficiently in prior art moderate voltage fields in respect to voltage withstanding capability, it has turned out that they are not necessarily satisfactory in applying to higher voltage fields.

On the other hand, a known contact-forming material for a vacuum interrupter is a Cu-Cr alloy containing Cr. The Cu-Cr alloy contact exhibits preferred thermal characteristic of Cr and Cu at a high temperature and therefore it has excellent characteristics in respects of high voltage withstanding capability and large current stability. That is, the Cu-Cr alloy is widely used as a contact wherein high voltage withstanding characteristic is compatible with large capacity interruption.

However, the Cu-Cr alloy exhibits greatly inferior anti-welding characteristic as compared with the Cu-Bi alloy containing no more than about 5% of Bi which has been generally widely used as the contact for the interrupter.

The welding phenomenon occurs by any of the following two causes: (a) the contact melts by Joule heat generated at the contacting surfaces of the contacts and thereafter solidifies and; (b) the contact gasifies by arc discharge generated in the instant of make and break, and thereafter solidifies.

In any cases, the Cu-Cr alloy forms fine grains of Cr and Cu having no more than 1 micrometer when it is solidified. Thus, the Cu-Cr alloy forms a layer having a thickness of the order of from several micrometers to several hundreds of micrometers in such a state that Cr fine grains and Cu fine grains are intermingled. Generally, super-refinement of a structure is one of factors which contribute to improvement of the strength of the material. In the Cu-Cr alloy, this is true. When the strength of the superfine Cu-Cr layer is larger than the strength of the matrix of the Cu-Cr alloy and the matrix strength exceeds designed opening force, welding generates.

Accordingly, operation mechanism by which a vacuum interrupter formed by using a contact of a Cu-Cr alloy is driven requires a larger opening force as compared with the vacuum interrupter formed by using the Cu-Bi alloy contact, and therefore the vacuum interrupter formed by using the Cu-Cr alloy contact is disadvantageous in respects of miniaturization and economy.

Japanese Patent Publication No. 41091/1986 discloses a contact of a Cu-Cr-Bi alloy wherein Bi is added to a Cu-Cr alloy in order to improve the anti-welding property of the Cu-Cr alloy. While this Cu-Cr-Bi alloy contact generally improves the anti-welding property of the Cu-Cr alloy to a certain extent, the addition of Bi remarkably embrittles the stuck, reduces voltage withstanding characteristic and increases restrike generation probability.

As described above, the contact of the Cu-Cr-Bi alloy has generally improved anti-welding property as compared with the contact of the Cu-Cr alloy. However, problems remain in respects of voltage withstanding characteristic and restrike generation.

SUMMARY OF THE INVENTION

It is therefore an object of the present invention to provide a contact for a vacuum interrupter capable of minimizing the reduction of voltage withstanding capability and the increase of restrike generation probability, while maintaining the anti-welding property of the Cu-Cr-Bi alloy contact.

A contact for a vacuum interrupter according to the present invention comprises one obtained by processing a contact-forming material comprising from 20% to 60% by weight of Cr, Bi in an amount of from 0.05% to 1.0% by weight of the total amount of Cu and Bi, and the balance substantially Cu into the shape of a contact, and subjecting the processed material to vacuum heat treatment.

DETAILED DESCRIPTION OF THE INVENTION

The forms of a Bi component present in a contact of a Cu-Cr-Bi alloy are classified into the following four forms:

(1) a Cu-Bi solid solution;

(2) presence of the Bi component in the interface of Cr grains and a Cu-based conductive material (a Cu matrix);

(3) presence of the Bi component in a Cu matrix grain boundary; and (4) presence of the Bi component within a Cu matrix grain.

Among these forms, a form which provides largest influence to the strength of the contact is the form wherein Bi is present in the Cu matrix grain boundary. The larger the amount of Bi in this grain boundary, the lower the contact strength. As a result, the voltage withstanding capability is reduced and the restrike generation probability is increased.

According to our finding, Bi present in the surface layer portion of the contact is effectively removed (volatilized) by processing the Cu-Cr-Bi contact-forming material into the shape of the contact and subjecting it to heat treatment in a vacuum. In addition, a portion or all of Cu-based grains and/or Cr grains which contact via Bi prior to heat treatment are intimately joined by elimination of Bi. As a result, the strength of the surface layer is improved, embrittlement of the surface of the contact is inhibited, whereby the reduction of voltage withstanding capability and the increase of restrike generation probability are inhibited. Bi is removed only at the surface layer portion of the contact and a specified amount of Bi is still present in the portions just below the surface layer portion. Welding opening is carried out from these portions and therefore the anti-welding property is scarcely reduced.

If the Bi content is less than 0.05% by weight based on the total amount of Cu+Bi, the anti-welding property will not be improved. If the Bi content exceeds 1.0% by weight, an effect obtained by applying the vacuum heat treatment described above will be not observed, an effect of improving the voltage withstanding capability and an effect of reducing the restrike generation probability will be insufficient. If the Cr content is less than 20% by weight, the Cu content will be excessively large and the voltage withstanding capability will be reduced. If the Cr content is more than 60% by weight, the amount of Cr will be excessively large and the embrittlement of the contact surface will not be prevented by vacuum heat treatment. Thus, the reduction of voltage withstanding capability and the increase of restrike generation probability cannot be inhibited.

If the vacuum heat treatment temperature is below about 300° C., the removal of Bi in the surface layer portion of the contact will be insufficient, and the improvement of voltage withstanding capability and the improvement of restrike generation probability will be insufficient. If the vacuum heat treatment temperature exceeds the melting point of Cu, the surface roughening of the contact will be remarkable. Accordingly, it is preferred that the vacuum heat treatment temperature be in the range of 300° to 1,083° C. The more preferred range is from 650° to 900° C. This heat treatment can be carried out once, twice or more after processing into the shape of a contact.

The heat treatment described above is carried out in a vacuum. "Vacuum heat treatment" as used herein refers to heat treatment carried out under a vacuum. By "vacuum" is meant a degree of vacuum sufficient to substantially volatilize Bi in the surface layer portion of the contact. Usually, when the heat treatment temperature is high, lower vacuum degree can be used. If the vacuum degree is too low, Cr in the alloy will be liable to be oxidized. The heat treatment is preferably carried out in a vacuum of not more than $1\times10^{-3}$ Torr., more preferably no more than $1\times10^{-4}$ Torr., particularly preferably not more than $1\times10^{-5}$ Torr.

The vacuum heat treatment described above can provide a contact wherein substantially no Bi is present in the surface layer portion of the contact. A structure having a Cu grain boundary locally remolten therein is formed at the surface layer of such a contact.

The present contact for vacuum circuit interrupter obtained by processing the Cu-Cr-Bi contact-forming material into the shape of the contact and subjecting it to vacuum heat treatment can have substantially the same voltage withstanding capability and restrike generation probability as those of the Cu-Cr contact-forming material while maintaining anti-welding characteristic.

The present invention will now be described with reference to embodiments.

First, processes for producing a contact according to the present invention will be described. Processes for producing a Cu-Cr-Bi alloy contact are broadly classified into an infiltration method and a solid phase method.

One embodiment of the infiltration method will be described.

A Cr powder having a specific grain size is pressure molded to obtain a powder molded product. The powder molded product is then presintered in a hydrogen atmosphere having a dew point of no more than −50° C. or under a vacuum of not more than $1\times10^{-3}$ Torr. at a specific temperature, for example, 950° C. (for one hour) to obtain a presintered body.

The remaining voids of the presintered body is then infiltrated with a Cu-Bi alloy material containing a specific percent of Bi, for example, for 30 minutes at a temperature of 1,100° C., and the whole is cooled and solidified in a specific cooling method to obtain a Cu-Cr-Bi alloy material. While the infiltration is principally carried out in a vacuum, it can also be carried out in hydrogen.

When high sintering heat treatment and/or infiltration heat treatment temperatures are selected, evaporation of Cu and Bi is vigorous and therefore control of the amounts of the components is important. The heat treatment temperature varies depending upon the performance of a furnace, the amount, size and heat capacity of a stock to be heat treated all at once, and the like, and therefore it is impossible to universally express the heat treatment temperature. While there can be used a method wherein the amount of the remaining Cu is directly determined and managed by an X-ray method or the like, the selection of the temperature of at least 1,300° C. generally reduces the presence of Cu and thus it is apparent that such a method is undesirable.

The lower limit of the temperature used in the sintering heat treatment must be at least 600° C., preferably at least 900° C. from the standpoint of degassing of the raw material or molded product. The lower limit of the temperature used in the infiltration heat treatment must be at least 1,100° C. because it is necessary to degas the skeleton and to melt Cu.

A Cu-Cr-Bi contact-forming material is thus obtained according to the infiltration method.

One embodiment of a solid phase sintering method will now be described.

Specific Cr, Cu and Bi powders are mixed. The resulting mixture is formed into a green compact by a pressing machine. The compact is then sintered in a hydrogen atmosphere having a dew point of no more than −50° C. or in a vacuum of not more than $1\times10^{-3}$ Torr. The pressing step and the sintering step are repeated many times to obtain a desired Cu-Cr-Bi contact-forming material.

The Cu-Cr-Bi contact-forming material thus produced by the infiltration method or solid phase sintering method is processed into the specific shape of a contact and thereafter heat treatment (for example, for 30 minutes at 800° C.) is carried out, for example, in a vacuum of $10^{-5}$ Torr. to obtain a contact of the present invention.

A preferred embodiment of the infiltration method will be described.

While the Cu-Cr contact-forming material having excellent voltage withstanding characteristic is generally used as the contact-forming material for the vacuum circuit interrupter as described above, its anti-welding property is inferior to that of the Cu-Bi contact-forming material. In order to improve the anti-welding property of the Cu-Cr contact-forming material and to obtain a contact-forming material for a vacuum circuit interrupter having excellent voltage withstanding characteristic (further to reduce restrike generation probability), the prior art process for producing a contact-forming material for a vacuum circuit interrupter is as follows.

For example, Japanese Patent Laid-Open Publication No. 88728/1990 discloses a process wherein a Cr skeleton obtained by sintering Cr is infiltrated with a Cu-Bi alloy to obtain a Cu-Cr-Bi contact-forming material. Further, Japanese Patent Laid-Open Publication No. 96621/1986 discloses a process wherein Cu, Bi and Cr powders are mixed, and the resulting mixture is formed into a contact-forming material by a powder metallurgy method.

We have found that the prior art processes can exhibit scattering in voltage withstanding characteristic and/or anti-welding characteristics even if the Cu-Cr-Bi contact-forming materials have the same composition.

The problems as described above can be overcome by using the following process. That is, a preferred process of the infiltration used in producing a contact-forming material is a process for producing a contact-forming material for a vacuum circuit interrupter comprising sintering a Cr powder to form a skeleton and infiltrating an infiltrating material composed of Cu and Bi into said skeleton, said process comprising the steps of compacting a mixture of a Cu powder and a Bi powder uniformly dispersed therein under a specific pressure, infiltrating the thus obtained Cu-Bi green compact into said Cr skeleton in a non-oxidizing atmosphere at a specific temperature, and cooling the alloy obtained by infiltration to obtain the contact-forming material for the vacuum circuit interrupter.

In such a process, the Cu-Bi mixture obtained by uniformly dispersing the Bi powder in the Cu powder is compact under a specific pressure, the resulting Cu-Bi green compact is infiltrated into the Cr skeleton at a specific temperature and the resulting alloy is cooled. Accordingly, the dispersion of the Bi powder is uniform and fine as compared with the melting method and the prior art infiltration method, whereby the scattering of voltage withstanding characteristic and anti-welding characteristic is effectively inhibited.

The process described above will be described in more detail.

A Cr powder having a specific grain size is pressure molded to obtain a powder molded product. This powder molded product is then presintered in a hydrogen atmosphere having a dew point of no more than −50° C. or in a vacuum of not more than $1\times10^{-3}$ Torr. at a specific temperature, for example, 950° C. (for one hour) to obtain a presintered body.

Cu and Bi powders having a specific grain size as infiltrants are mixed in a specific ratio by considering yield, the Bi powder is sufficiently uniformly dispersed in the Cu powder, and thereafter the mixture is formed into a Cu-Bi green compact under a molding pressure of 3 metric tons per square centimeter. Optionally, the compact is heat treated in a hydrogen atmosphere, for example, at 400° C. for about 30 minutes to obtain a compact which is an infiltrant. The compact can be heat treated in a vacuum.

Stable voltage withstanding characteristic and anti-welding characteristic are obtained by uniformly dispersing Bi. The dispersion state of Bi in the Cu-Cr-Bi contact depends upon the dispersion state of Bi in the infiltrant composed of Cu and Bi. That is, when the Cr skeleton is infiltrated with the Cu-Bi infiltrant in an inert gas or in a vacuum, a long infiltration time is not used by considering the fact that Bi is a high vapor pressure element. Accordingly, the dispersion state of Bi in the infiltrant prior to infiltration is one of factors which determine the dispersion state of Bi after infiltration.

When the Cu-Bi infiltrant is produced by the melting method, the addition of Bi results in the formation of the finer grain size of the Cu matrix as compared with pure Cu. However, according to structure observation, the Cu matrix is coarse to such an extent that the grain is visually discernible, and accordingly the dispersion of Bi is coarse as well. On the contrary, the dispersion state of Bi in the Cu-Bi compact prepared by mixing and shaping Cu and Bi powders of the order of from several micrometers to several hundreds of micrometers is better than that of the Cu-Bi alloy prepared by the melting method. The dispersion state of Bi in the infiltrant described above dominates the dispersion state of Bi after infiltration. The dispersion state of Bi in the Cu-Cr-Bi contact obtained by using the Cu-Bi compact is better than that of infiltrant obtained by the melting method. As a result, the scattering of voltage withstanding characteristic and welding characteristic of the Cu-Cr-Bi contact-forming material can be reduced.

The Cu and Bi powders from which the infiltrant is prepared are liable to be oxidized. When these powders after allowing to stand for a long period of time in air are used, the following method is preferably used. The powders are compacted and the resulting compact prior to infiltration is heat treated in hydrogen. Such a method provides good characteristics to a Cu-Cr-Bi contact after infiltration.

The remaining voids of the presintered body is then infiltrated with the Cu-Bi compact described above, for example, for 30 minutes at a temperature of 1,100° C., and the whole is cooled and solidified in a specific cooling method to obtain a Cu-Cr-Bi alloy material. While the infiltration is principally carried out in a vacuum, it can also be carried out in hydrogen.

When high sintering heat treatment and/or infiltration heat treatment temperatures are selected, evaporation of Cu and Bi is vigorous and therefore control of the amounts of the components is important. The heat treatment temperature varies depending upon the performance of a furnace, the amount, size and heat capacity of a stock to be heat treated all at once, and the like, and therefore it is impossible to universally express the heat treatment temperature. While there can be used a method wherein the amount of the remaining Cu is directly determined and managed by an X-ray method or the like, the selection of the temperature of at least 1,300° C. generally reduces the pressure of Cu and thus it is apparent that such a method is undesirable.

The lower limit of the temperature used in the sintering heat treatment must be at least 600° C., preferably at least 900° C. from the standpoint of degassing of the raw material or molded product. The lower limit of the temperature used in the infiltration heat treatment must be at least 1,100° C. because it is necessary to degas the skeleton and to melt Cu.

A Cu-Cr-Bi contact-forming material is thus obtained according to the infiltration method. The Cu-Cr-Bi alloy contact produced by the infiltration method exhibits the scattering of voltage withstanding characteristic and welding characteristic smaller than that of the Cu-Cr-Bi alloy contact obtained by infiltrating the Cu-Bi alloy obtained by the melting method. Thus, stable performance can be obtained by the infiltration method and the Cu-Cr-Bi alloy contact obtained by the infiltration method is optimum as a contact for a vacuum circuit interrupter.

Contact characteristics can be further improved by subjecting the contact-forming material obtained by the infiltration method as described above to the vacuum heat treatment described above.

The following Examples and Comparative Examples illustrate the present invention.

The conditions and methods used in evaluating the properties of contacts are as follows.

(1) Anti-welding Property

Pressure rods having an outer diameter of 25 millimeters and having an end exhibiting a radius of curvature of 100R were opposed to a pair of disc-shaped samples having an outer diameter of 25 millimeters. A load of 100 kilograms was applied and a current of 50 Hz and 20 KA was passed through the samples for 20 milliseconds in a vacuum of $10^{-5}$ mmHg. A force required for opening between the samples and the rod was measured and the anti-welding property was judged. The numerical values are relative values obtained when the welding opening force of the infiltered Cu-Cr alloy material shown in Comparative Example A1 is expressed as 1.0. Table 1 shows the scattering width of measured values (number of contacts: 3)

(2) Voltage Withstanding Characteristic

An Ni needle which had been mirror finished by buffing was used as an anode. Each sample obtained by mirror finishing it and thereafter subjecting it to vacuum heat treatment was used as a cathode. The gap between the anode and the cathode was 0.5 millimeters. A voltage was gradually increased in a vacuum of $10^{-6}$ mmHg, and a voltage value was measured when a spark was generated. Thus, static withstand voltage values were determined. The data obtained by carrying out three repeating tests are shown in Table 1 (including their scattering). The numerical values are relative values obtained when the static withstand voltage values of the infiltrated Cu-Cr alloy are expressed as 1.0 (Comparative Example A1).

(3) Restrike Characteristic

A disc-shaped contact piece having an outer diameter of 30 millimeters and a thickness of 5 millimeters was mounted on a demountable vacuum circuit interrupter. A circuit of 6 KV and 500 A was interrupted 2,000 times and restrike generation frequency was measured. The scattering width (maximum and minimum) of two circuit interrupters (6 valves) is shown.

EXAMPLES A1 THROUGH A3 AND COMPARATIVE EXAMPLES A1 THROUGH A4

Contacts containing about 50 wt % of Cr and Bi in an amount of about 0.5 wt % of the total amount of Cu and Bi were used. The following heat treatment conditions were used: none; 200° C.×1 hr; 300° C.×1 hr; 800° C.×1 hr; 1,050° C.×1 hr; and 1,200° C.×1 hr. Each characteristic was evaluated. (Comparative Examples A2 and A3, Examples A1 through A3 and Comparative Example A4) As shown in Table 1, anti-welding characteristic is greatly better than that of the Cu-Cr contact containing no Bi (Comparative Example A1). Voltage withstanding characteristic and restrike generation probability greatly depend upon the heat treatment temperature. That is, in the cases of the sample wherein no heat treatment was carried out after processing the contact (Comparative Example A2) and the sample wherein the heat treatment temperature is 200° C. (Comparative Example A3), the removal of Bi at the surface of the contact is insufficient, and therefore the improvement of voltage withstanding capability and the improvement of restrike generation probability are not observed. In the case of the sample wherein the heat treatment temperature exceeds the melting point of Cu (Comparative Example A4), the surface roughening of the contact is remarkable and it is impossible to measure characteristics. On the contrary, in the cases of the samples wherein heat treatment temperature is 300° C., 800° C. and 1,050° C., respectively (Examples A1, A2 and A3), it is observed that both voltage withstanding characteristic and restrike generation probability are improved.

EXAMPLES A2, A4 AND A5 AND COMPARATIVE EXAMPLES A5 AND A6

The characteristics of Cu-Cr-Bi contacts containing 50 wt % of Cr and Bi in an amount of 0.01, 0.05, 0.43, 0.97 and 5.6 wt % of the total amount of Cu and Bi were evaluated. (Comparative Example A5, Examples A4, A2 and A5, and Comparative Example A6) As shown in Table 1, in the case of the contact containing a smaller content of Bi (Comparative Example A5), its voltage withstanding characteristic and restrike generation probability are good. However, the improvement of anti-welding property is scarcely observed. On the other hand, in the case of the contact containing a larger contact of Bi (Comparative Example A6), a heat treatment-derived effect is not observed and the increase of restrike generation probability and the reduction of voltage withstanding characteristic are remarkable. As can be seen from the foregoing, the amount of Bi based on the total amount of Cu and Bi is suitably from 0.05 to 1.0 wt %.

EXAMPLES A6 THROUGH A8 AND COMPARATIVE EXAMPLES A7 AND A8

The effective range of the content of Cr was examined. Cu-Cr-Bi alloy contacts containing 12.3, 22.5, 47.9, 59.1 or 87.6 wt % or Cr were examined. (Comparative Example A7, Examples A6 through A8 and Comparative Example A8) The characteristics of each contact were evaluated. All of the contact exhibit a good anti-welding property. However, in the case of the contact containing 12.3 wt % of Cr (Comparative Example A7), the amount of Cu is excessively large and therefore the remarkable reduction of voltage withstanding capability is observed, although such a contact does not pose any problem in the respect of restrike generation. In the case of the contact containing 87.6 wt % of Cr (Comparative Example A8), the amount of Cr is excessively large and therefore it is impossible to provide the embrittlement prevention of the contact surfaces by heat treatment and both voltage withstanding characteristic and restrike generation probability obtained are not good. On the other hand, all of the contacts containing 22.5, 47.9 and 59.1 wt % of Cr (Examples A6 through A8) show good results. As can be seen from the foregoing, it is desirable that the percent of Cr be from 20 to 60 wt %.

TABLE 1

| | Analytical Value | | Heat Treatment Condition after | Characteristic | | |
|---|---|---|---|---|---|---|
| | Cr | Bi/Cu + Bi × 100 | Contact Processing (Vacuum Atmosphere) | Anti-welding Characteristic | Voltage Withstanding Characteristic | Restrike Generation Probability |
| Comp. Exam. A1 | 52.6 | — | none | 1.0 | 1.0 | 0.05–0.1 |
| Comp. Exam. A2 | 50.3 | 0.43 | none | 0.3–0.4 | 0.7 | 0.8–1.6 |
| Comp. Exam. A3 | 50.3 | 0.43 | 200° C. × 1 Hr | 0.3–0.4 | 0.7 | 0.8–1.5 |
| Exam. A1 | 50.3 | 0.43 | 300° C. × 1 Hr | 0.3–0.4 | 0.9 | 0.1–0.3 |
| Exam. A2 | 50.3 | 0.43 | 800° C. × 1 Hr | 0.4–0.5 | 0.9 | 0.05–0.1 |
| Exam. A3 | 50.3 | 0.43 | 1050° C. × 1 Hr | 0.4–0.5 | 0.9 | 0.05–0.1 |
| Comp. Exam. A4 | 50.3 | 0.43 | 1200° C. × 1 Hr | impossible to measure due to Cu melting | | |
| Comp. Exam. A5 | 47.6 | 0.01 | 800° C. × 1 Hr | 0.95–0.1 | 1.0 | 0.05–0.1 |
| Exam. A4 | 48.7 | 0.05 | 800° C. × 1 Hr | 0.6–0.7 | 0.95 | 0.05–0.1 |
| (Exam.-A2) | 50.3 | 0.43 | 800° C. × 1 Hr | 0.4–0.5 | 0.9 | 0.05–0.1 |
| Exam. A5 | 52.8 | 0.97 | 800° C. × 1 Hr | 0.3–0.4 | 0.9 | 0.1–0.2 |
| Comp. Exam. A6 | 46.7 | 5.6 | 800° C. × 1 Hr | 0.2–0.3 | 0.6 | 0.8–1.6 |
| Comp. Exam. A7 | 12.3 | 0.52 | 800° C. × 1 Hr | 0.3–0.4 | 0.6 | 0.1–0.2 |
| Exam. A6 | 22.5 | 0.46 | 800° C. × 1 Hr | 0.3–0.4 | 0.9 | 0.1–0.2 |
| Exam. A7 | 47.9 | 0.51 | 800° C. × 1 Hr | 0.3–0.4 | 0.9 | 0.1–0.2 |
| Exam. A8 | 59.1 | 0.42 | 800° C. × 1 Hr | 0.3–0.4 | 0.9 | 0.1–0.2 |
| Comp. Exam. A8 | 87.6 | 0.61 | 800° C. × 1 Hr | 0.2–0.3 | 0.7 | 0.8–1.6 |

Examples described above are directed to such cases that contact alone is heat treated. Even if heat treatment which is a feature of the present invention is carried out in any step used until the contact is assembled into a vacuum circuit interrupter, it is apparent that the improvement of characteristics similar to those described above can be obtained.

As described above, according to the present invention, the reduction of voltage withstanding characteristic and the increase of restrike generation probability can be minimized while maintaining the anti-welding property of the Cu-Cr-Bi alloy contact for the vacuum circuit interrupter.

Example wherein contacts are produced by the infiltration method will be described.

The conditions and methods used in evaluating the properties of contacts are as follows.

(1) Anti-welding Property

Pressure rods having an outer diameter of 25 millimeters and having an end exhibiting a radius of curvature of 100 R were opposed to a pair of disc-shaped samples having an outer diameter of 25 millimeters. A load of 100 kilograms was applied and a current of 50 Hz and 20 KA was passed through the samples for milliseconds in a vacuum of $10^{-5}$ mmHg. A force required for opening between the samples and the rod was measured and the anti-welding property was judged. The numerical values are relative values obtained when the welding opening force of the infiltrated Cu-Cr alloy material shown in Comparative Example B1 is expressed as 1.0. Table 2 shows the scattering width of measured values (number of contacts: 10).

(2) Voltage Withstanding Characteristic

An Ni needle which had been mirror finished by buffing was used as an anode. Each sample obtained by mirror finishing it and thereafter subjecting it to vacuum heat treatment was used as a cathode. The gap between the anode and the cathode was 0.5 millimeters. A voltage was gradually increased in a vacuum of $10^{-6}$ mmHg, and a voltage value was measured when a spark was generated. Thus, static withstand voltage values were determined. The data obtained by carrying out ten tests are shown in Table 2 (including their scattering). The numerical values are relative values obtained when the static withstand voltage values of the infiltrated Cu-Cr alloy are expressed as 1.0 (Comparative Example B1).

The above samples for measuring anti-welding property and voltage withstanding characteristic are those obtained by processing into the shape of the sample described above and subjecting it to vacuum heat treatment.

EXAMPLES B1 AND COMPARATIVE EXAMPLES B1 AND B2

Contacts containing about 50 wt % of Cr and Bi in an amount of about 0.4 wt % of the total amount of Cu and Bi were produced. Molten Cu-Bi was used as an infiltrant (Comparative Example B2), and a green compact composed of Cu and Bi powders was used as an infiltrant (Example B1). Their characteristics were compared. As shown in Table 2, the anti-welding property is greatly better than that of the Cu-Cr contact obtained by the prior art infiltration method (Bi=0, Comparative Example B1). When their scattering width is compared, Example B1 wherein the compact is used exhibits a slight scattering width, whereas Comparative Example B2 wherein Cu-Bi obtained by the melting method is used exhibits a large scattering width. While the measurement results exhibit the fact that the scattering width of Comparative Example B2 is large, the upper limit of the scattering width is 0.6 times that of Comparative Example B1 containing no Bi, and it is in the practically effective range. Similar tendency is observed in voltage withstanding characteristic. Example B1 wherein the compact is used exhibits the reduction of voltage withstanding characteristic smaller than that of Comparative Example B1 and exhibits a scattering width less than that of Comparative Example B1, whereas Comparative Example B2 wherein Cu-Bi obtained by the melting method is used exhibits a large scattering and, in some cases, the lower limit is 0.6. Thus, the contact of Comparative Example B2 is not necessarily suitable as a contact for a vacuum circuit interrupter.

The results described above demonstrate that the contacts exhibiting a small scattering in voltage withstanding characteristic and anti-welding characteristic can be obtained by using the Cu-Bi compact as the infiltrant.

teristic is slightly lower than that of Example B1. However, its anti-welding characteristic is substantially the same as that of Example B1, and Example B4 poses no problems in using as a contact for a vacuum circuit interrupter. It is confirmed that the same voltage withstanding characteristic as the Example B1 is obtained by using the identical Cu powder and heat treating a green compact prior to infiltration (Example B5), and the effectiveness of heat treatment of the compact is confirmed.

The wt % of Cr is not limited to Examples described above. It is apparent that all of Cu-Cr-Bi contacts which can be produced by the infiltration method can be used in the present invention.

As described above, the infiltration method according to the present invention uses the process comprising the steps of compacting a mixture of a Cu powder and a Bi powder uniformly dispersed therein under a specific pressure, infiltrating the resulting Cu-Bi green compact into a Cr skeleton in a non-oxidizing atmosphere at a specific temperature, and cooling the resulting alloy. Accordingly, excellent contact-forming materials capable of inhibiting the scattering of voltages withstanding characteristic and anti-welding characteristic can be obtained.

TABLE 2

| | Analytical Value | | | | Characteristic | | |
|---|---|---|---|---|---|---|---|
| | Cr (wt %) | Bi/Cu + Bi × 100 (wt %) | Process For the Preparation of Infiltrant | Heat Treatment of Infiltrant | Anti-welding Characteristic | Voltage Withstanding Characteristic | Remark |
| Comp. Exam. B1 | 51.4 | — | Molten Oxygen-free Copper | without | 1.0 | 1.0 | |
| Comp. Exam. B2 | 50.3 | 0.43 | Molten Cu-Bi | without | 0.3–0.6 | 0.6–0.9 | |
| Exam. B1 | 52.7 | 0.39 | Green Compact Cu-Bi | without | 0.3–0.4 | 0.8–0.9 | |
| Comp. Exam. B3 | 48.5 | 0.01 | " | " | 0.95–1.0 | 1.0 | |
| Exam. B2 | 53.8 | 0.05 | " | " | 0.6–0.7 | 0.9–0.95 | |
| (Exam.-B1) | 52.7 | 0.39 | " | " | 0.3–0.4 | 0.8–0.9 | |
| Exam. B3 | 47.1 | 0.95 | " | " | 0.3–0.4 | 0.8–0.9 | |
| Comp. Exam. B4 | 51.6 | 5.3 | " | " | 0.2–0.3 | 0.5–0.6 | |
| Exam. B4 | 35.2 | 0.41 | " | " | 0.3–0.4 | 0.7–0.8 | Remarkably oxidized Cu powder was used |
| Exam. B5 | 36.4 | 0.43 | " | with | 0.3–0.4 | 0.8–0.9 | Remarkably oxidized Cu powder was used |

EXAMPLES B2, B1 AND B3, AND COMPARATIVE EXAMPLES B3 AND B4

The characteristics of Cu-Cr-Bi contacts containing 50 wt % of Cr, and Bi in an amount of 0.01, 0.05, 0.39, 0.95 and 5.3 wt % of the total amount of Cu and Bi were evaluated. (Comparative Example B3, Examples B2, B1 and B3, and Comparative Example B4) As shown in Table 2, in the case of the contact containing a smaller content of Bi (Comparative Example B3), its voltage withstanding characteristic is good. However, the improvement of anti-welding property is scarcely observed. On the other hand, in the case of the contact containing a larger content of Bi (Comparative Example B4), the reduction of voltage withstanding characteristic is remarkable. As can be seen from the foregoing, the amount of Bi based on the total amount of Cu and Bi is suitable from 0.05 to 1.0 wt %.

EXAMPLES B4 AND B5

There is examined the case wherein remarkably oxidized Cu is used as a raw material of a green compact for an infiltrant.

When a remarkably oxidized Cu powder is used as shown in Example B4, its voltage withstanding charac-

What is claimed is:

1. A contact for a vacuum interrupter obtained by processing a contact-forming material comprising from 20% to 60% by weight of Cr, Bi in an amount of from 0.05% to 1.0% by weight of the total amount of Cu and Bi, and the balance substantially Cu into the shape of a contact, and thereafter subjecting the thus processed material to vacuum heat treatment.

2. The contact for the vacuum interrupter according to claim 1, wherein said vacuum heat treatment is carried out at a temperature in the range of 300° C. to 1,083° C.

3. The contact for the vacuum interrupter according to claim 1, wherein said vacuum heat treatment is carried out in a vacuum sufficient to substantially volatilize Bi present in the surface layer of the contact-forming material being processed into the shape of the contact.

4. The contact for the vacuum interrupter according to claim 1, wherein said vacuum heat treatment is carried out in a vacuum of not more than $1\times10^{-3}$ Torr.

5. The contact for the vacuum interrupter according to claim 1, wherein a structure having a Cu grain boundary locally remolten therein is formed at the surface layer of the contact.

6. The contact for the vacuum interrupter according to claim 1, wherein the contact-forming material prior to processing into said shape of the contact is produced by the steps of:

a) providing a skeleton composed of a Cr sintered body; and b) infiltrating said skeleton with an infiltrating material composed of a green compact of a mixture of a Cu powder and a Bi powder.

7. A contact for a vacuum interrupter according to claim 1, wherein the contact-forming material prior to processing into the shape of the contact is produced by mixing Cr, Cu, and Bi powder and forming the resulting mixture into a green compact by pressing and then sintering the green compact.

8. A contact for a vacuum interrupter according to claim 1, wherein a portion or all of the Cu grains and/or Cr grains which contacted Bi prior to the vacuum heat treatment, are intimately joined during the vacuum heat treatment by elimination of Bi.

9. A contact for a vacuum interrupter according to claim 1, wherein after the vacuum heat treatment, Bi still remains below the surface layer of the contact.

10. A contact for a vacuum interrupter according to claim 1, which before said vacuum heat treatment comprises about 40 to about 80% by weight of copper.

11. A contact for a vacuum interrupter according to claim 2, wherein said temperature is in the range of from 650° C. to 900° C.

12. A contact for a vacuum interrupter according to claim 4, wherein said vacuum is not more than $1\times10^{31}$ 4 Torr.

13. A contact for a vacuum interrupter according to claim 4, wherein said vacuum is not more than $1\times10^{-5}$ Torr.

14. A contact for a vacuum interrupter according to claim 6, wherein in said green compact, the Bi is uniformly dispersed in the Cu.

15. A contact for a vacuum interrupter which due to a vacuum heat treatment after the shaping of the contact comprises substantially no Bi on the surface layer of the contact, which comprises before said vacuum heat treatment 20 to 60% by weight of chromium, bismuth in an amount of 0.05 to 1.0% by weight of the total amount of copper and bismuth, and the balance substantially copper.

16. A contact for a vacuum interrupter according to claim 15, wherein the surface layer comprises a copper grain boundary.

17. A contact for a vacuum interrupter according to claim 15, comprising about 47 to about 59% by weight of chromium before said vacuum heat treatment.

18. A contact for a vacuum interrupter according to claim 15, comprising about 0.39 to about 0.51% by weight of bismuth before said vacuum heat treatment.

19. A contact for a vacuum interrupter according to claim 15, which before said vacuum heat treatment comprises about 40 to about 52% by weight of copper.

20. A contact for a vacuum interrupter comprising chromium and copper, wherein the surface layer of the contact comprises a copper grain boundary, wherein substantially no bismuth is present on said surface layer, and wherein Bi is present below the surface layer of the contact.

* * * * *